United States Patent [19]

Hirata

[11] 4,082,982

[45] Apr. 4, 1978

[54] AUTOMATIC ELECTRONIC FLASH DEVICE

[75] Inventor: Shinji Hirata, Osaka, Japan

[73] Assignee: West Electric Company, Ltd., Osaka, Japan

[21] Appl. No.: 769,710

[22] Filed: Feb. 17, 1977

[30] Foreign Application Priority Data

Feb. 19, 1976 Japan ..... 51-17652

[51] Int. Cl.[2] ..... H05B 41/30; H05B 41/36

[52] U.S. Cl. ..... 315/151; 315/241 P

[58] Field of Search ..... 315/151, 241 R, 241 P

[56] References Cited

U.S. PATENT DOCUMENTS

| | | | |
|---|---|---|---|
| Re. 28,025 | 5/1974 | Murata et al. | 315/151 |
| 3,626,246 | 12/1971 | Higuchi | 315/151 X |
| 3,809,951 | 5/1974 | Vital et al. | 315/241 P X |

*Primary Examiner*—Alfred E. Smith
*Assistant Examiner*—Charles F. Roberts
*Attorney, Agent, or Firm*—Stevens, Davis, Miller & Mosher

[57] ABSTRACT

An automatic electronic flash device including: a flash discharge tube, a first switching element connected in series with the flash discharge tube, a main discharge capacitor adapted to supply its charged energy to the flash discharge tube for firing thereof so that an object to be photographed is illuminated, a light receiving circuit which receives light reflected from the object for turning on a second switching element when the amount of the received light reaches a predetermined value, a commutation capacitor which is made to discharge in response to the second switching element being turned on and supplies a reverse current through the first switching element whereby the first switching element is turned off so as automatically to stop illuminating, a trigger circuit for supplying a high voltage pulse to the trigger electrode of the flash discharge tube, and a high voltage supply circuit which generates a high voltage in synchronism with the operation of the trigger circuit so that the generated voltage is superposed on the charging voltage of the main discharge capacitor for being applied across the main electrodes of the flash discharge tube.

3 Claims, 5 Drawing Figures

AUTOMATIC ELECTRONIC FLASH DEVICE

FIELD OF THE INVENTION

The present invention relates to an automaic electronic flash device and, in particular, that having a flash discharge tube capable of being fired easily and reliably.

DESCRIPTION OF THE PRIOR ART

An automatic electronic flash device having a flash discharge tube and a switching element connected in series with the flash discharge tube is disclosed in U.S. Pat. No. Re 28,025. This device is advantageous in that the main discharge capacitor which supplies firing energy to the flash discharge tube does not exhaust all its charges at a time but only a necessary amount thereof and therefore, when the distance to an object to be photographed is short, it is possible to repeat illumination successively in a short time interval.

However, on the other hand:

(1) Since, in the case of illumination a large current of several hundred amperes is made to flow through the switching element connected in series with the flash discharge device, the switching element is required to be of large capacity and further to be short in turn-off time for the purpose of rapidly stopping illumination. Thus the switching element is inevitably expensive. (2) A commutation capacitor which is used, in the case of illumination, to turn off by forcing a reverse current the switching element having a current of several hundred amperes flowing therethrough is required to be a film capacitor which is non-polar, large in capacity and size and expensive. (3) When the flash discharge tube is made to repeat illumination many times successively in a short time interval, the flash discharge tube is elevated rapidly in temperature and its firing voltage is increased thus sometimes causing the instability in illumination. With respect to the above-mentiond problems (1) and (2), if the flash discharge tube is made to have a high internal impedance, the switching element is depressed in its current flowing therethrough and, together with the commutation capacitor, can be made small in capacity. However, then, when the internal impedance is high, the firing voltage is increased and the instability in illumination can be caused possibly not only in the case of successive illumination as in paragraph (3) but also in the case of single illumination.

SUMMARY OF THE INVENTION

An object of the present invention is to provide an economical electronic flash device wherein, in order to solve the hereinbefore described problems, a voltage which is to be applied to a discharge tube together with and in a superposed relation to the voltage of a main discharge capacitor is generated by a circuit construction.

Further objects, features and advantages of the present invention will be apparent from the following description taken in conjunction with the accompanying drawings.

DESCRIPTION OF THE PREFERRED EMBODIMENTS

Now, an automatic electronic flash device according to the present invention will be described in detail with respect to some embodiments.

Figure 1:
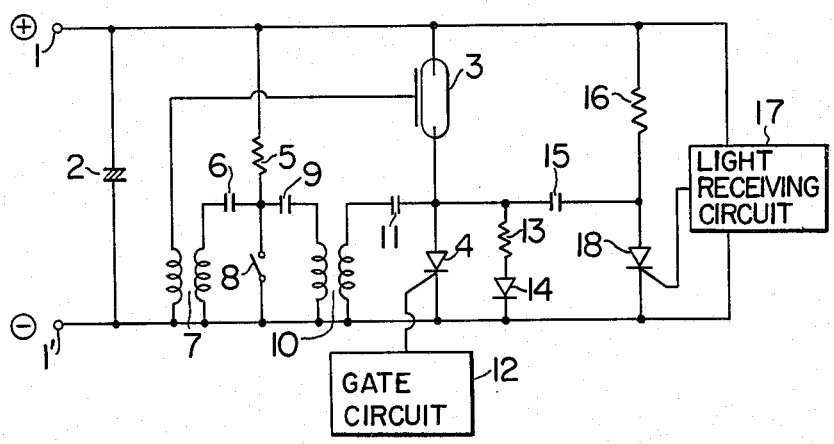
FIG. 1 is an electric circuit of an embodiment of an automatic electronic flash device according to the present invention.

In an embodiment shown in FIG. 1, reference numerals 1 and 1' are terminals to which is applied a high voltage D.C. source, numeral 2 is a main discharge capacitor which stores ignition energy, numeral 3 is a flash discharge tube, and numeral 4 is an SCR which is a switching element having an anode, a cathode and a control electrode and is connected in series with the flash discharge tube. Numeral 5 is a resistor, numeral 6 is a trigger capacitor, numeral 7 is a trigger transformer which generates a high voltage pulse adapted to be supplied to the trigger electrode of the flash discharge tube 3, numeral 8 is a switch, numeral 9 is a capacitor, numeral 10 is a transformer which generates at its secondary winding a high voltage when the capacitor 9 discharges as the switch 8 is closed, numeral 11 is a capacitor which is connected between the secondary winding of the transformer 11 and the anode side of the SCR, and numeral 12 is a gate circuit which operates in synchronism with the closure of the switch 8 and supplies a gate voltage for turning on the SCR 4 to the gate thereof. Numerals 13 and 16 are resistors for charging a commutation capacitor 15, numeral 14 is a diode, numeral 17 is a light receiving circuit which receives light reflected from an object to be photographed, and numeral 18 is an SCR which is a switching element adapted to be turned on in response to a flash stopping signal from the light receiving circuit 17.

The switching element 18 may be a gas discharge tube, instead of an SCR, which contains a low pressure gas and is adapted to discharge between its main electrodes in response to its trigger electrode receiving a high voltage.

When a D.C. source is supplied across the terminals 1 and 1' to have the main discharge capacitor 2, the trigger capacitor 6, the capacitor 9, the commutation capacitor 15 charged to respective predetermined values, the flash discharge device 3 is, in response to the switch 8 turned on, excited by a high voltage pulse generated in the trigger transformer 7 and, at the same time, the SCR 4 is supplied at its control electrode with a gate voltage by the operation of the gate circuit 12 thereby to be made conductive whereby the flash discharge tube 3 consumes the charged energy in the main discharge capacitor 2 to flash for illuminating the object to be photographed.

The light reflected back from the object is received by the light receiving circuit 17 and, as the received light reaches a predetermined value, the SCR 18 is turned on to make the commutation capacitor 15 discharge so that a reverse current flows through the SCR 4 to turn off it thus causing the flash discharge tube 3 to stop flashing.

Figure 2:
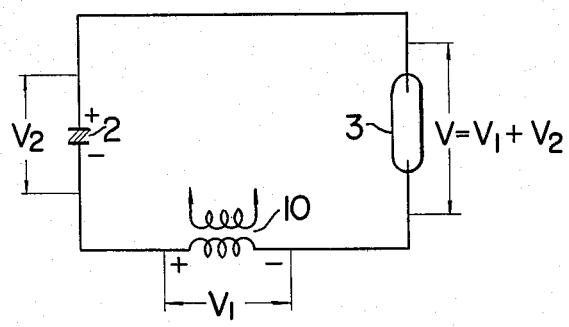
FIG. 2 is a diagram explaining the ignition operation of a flash discharge tube of the embodiment shown in FIG. 1.

The amount of flashing is controlled as described above. Next, the ignition mechanism of the flash discharge tube 3 which is an object of the present invention will be described in detail. When the switch 8 is turned on, the trigger capacitor 6 is discharged and, at the same time, the capacitor 9 discharges through the primary winding of the transformer 10 to cause a high voltage to be generated across the secondary winding so that, as shown in FIG. 2, the generated voltage $V_1$ of the illustrated polarity is superposed on the charging voltage $V_2$ of the main discharge capacitor 2.

The superposed voltage $V = V_1 + V_2$ is applied across the main electrodes of the flash discharge tube 3 so that the flash discharge tube 3 can be flashed readily and reliably by both the superposed voltage and the high voltage pulse from the trigger transformer 7.

The capacitor 11 serves to prevent the charges in the main discharge capacitor 2 from being discharged in a D.C. manner through the flash discharge tube 3 and the secondary winding of the transformer, and the diode 14 serves to prevent a current of the opposite polarity from flowing through the secondary winding of the transformer 10, the capacitor 11 and the resistor 13. That is, although the diode 14 is not necessarily required when the value of the resistor 13 is large, the value of the resistor 13 must be small when the commutation capacitor 15 is required to be charged rapidly and, as a result, the voltage of the polarity as shown in FIG. 2 across the secondary winding side of the transformer 10 is bypassed through the resistor 13 thus causing the flash discharge tube 3 not to have a sufficiently high voltage across its electrodes.

Figure 3:
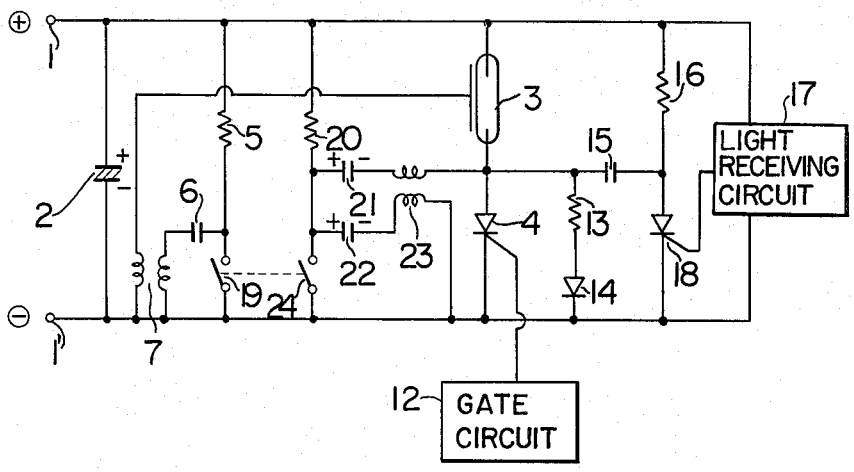
FIG. 3 is an electric circuit of another embodiment of an automatic electronic flash device according to the present invention.

FIG. 3 shows another embodiment of the present invention which is adapted to be applied with higher voltage than in the above-described embodiment. In FIG. 3, the same reference numerals as in FIG. 1 indicate elements having the similar functions.

In FIG. 3, when a switch 24 is turned on in an interlocking relation to a switch 19, a high voltage pulse is generated to be applied to the flash discharge tube 3 and, at the same time, the charges in the capacitor 22 is discharged through the primary winding of a transformer 23 to generate a voltage across its secondary winding.

Figure 4:
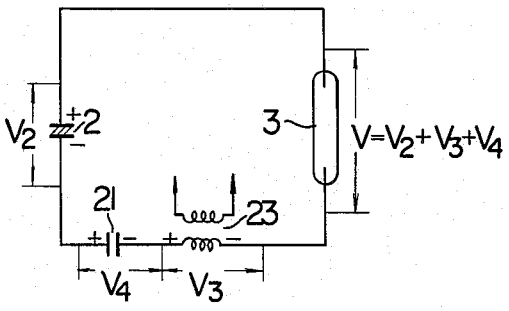
FIG. 4 is a diagram explaining the ignition operation of a flash discharge tube of the embodiment shown in FIG. 3.

The voltage generated across the secondary winding is, as in the previous embodiment, superposed on the charging voltage of the main discharge capacitor 2 through the switch 24. However, in this case, the charging voltage of the capacitor 21 is further superposed as shown in FIG. 4, that is, the charging voltage $V_2$ of the main discharge capacitor 2, the charging voltage $V_4$ of the capacitor 21 and the voltage $V_3$ generated across the secondary winding of the transformer 23 are superposed on each other and the superposed voltage $V = V_2 + V_3 + V_4$ which is higher than in the previous embodiment is applied across the main electrodes of the flash discharge tube 3 for firing more readily and reliably.

As in the previous embodiment, although, as soon as the flash discharge tube 3 is excited, the charges in the main discharge capacitor 2 tend to be discharged through the secondary winding of the transformer 23; the capacitor 21 prevents this discharge in a D.C. manner.

Figure 5:
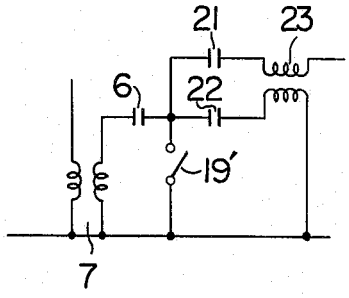
FIG. 5 is a partial electric circuit of still another embodiment of an automatic electronic flash device according to the present invention.

Although, in this embodiment, the switch 19 is interlocked with the switch 24, it is not always necessary to have two switches interlocked with each other but a single switch 19' can be substituted for these by means of the connection as shown in FIG. 5.

As described above, since the automatic electronic flash device according to the present invention can be applied across the main electrodes of its flash discharge tube with a very high voltage for exciting and firing, flash discharge tubes of high impedance can be used and, as a result, switching elements connected in series with the discharge tube and commutation capacitor elements can be made small in capacity and cheap in cost and further it is possible to flash many times reliably and successively in a short time interval.

Further, even when a plurality of flash discharge tubes according to the present invention are connected in series for improving the amount and arrangement of illumination, they can be discharged for illumination reliably. Still further, although a flash discharge tube tends in general to have a higher firing voltage in the dark, the flash discharge tube according to the present invention never becomes unstable in such circumstances.

Today, a flash discharge tube is restricted with respect to firing voltage depending on the kind of its flashing device. However, this restriction is lightened to a considerable extent in the device according to the present invention. Thus, the present invention is very effective also in manufacturing flash discharge tubes.

What is claimed is:

1. An automatic electronic flash device comprising:
- a series connection of a first switching element which includes an anode, a cathode and a control electrode and a flash discharge tube,
- a main discharge capacitor which is connected in parallel with said series connection and is adapted to be charged to high voltage,
- a trigger circuit which includes a trigger capacitor and a trigger transformer, the charged energy of said trigger capacitor being discharged through the primary winding of said trigger transformer thereby to generate a high voltage pulse through the secondary winding of said trigger transformer, and said high voltage pulse being fed to the trigger electrode of said flash discharge tube,
- a gate circuit which supplies a gate voltage to said control electrode of said first switching element,
- a light receiving circuit which receives light reflected from an object to be photographed and supplies a flash stopping signal when the amount of the received light reaches a predetermined value,
- a second switching element which is turned on in response to said flash stopping signal,
- a commutation capacitor which is made to discharge in response to said second switching element being turned on and supplies a reverse current between said anode and said cathode of said first switching element thereby to turn off said first switching element, and
- a high voltage supply circuit which generates a high voltage in synchronism with the operation of said trigger circuit so that the generated voltage is superposed on the charging voltage of said main discharge capacitor and the resulting voltage is applied across the main electrodes of said flash discharge tube.

2. An automatic electronic flash device as defined in claim 1, in which said high voltage supply circuit comprises a switch serving also to start the operation of said trigger circuit, a capacitor, and a transformer having a primary winding and a secondary winding; said switch, said capacitor and said primary winding forming a closed circuit, and said secondary winding of said transformer being connected between said flash discharge tube and said main discharge capacitor.

3. An automatic electronic flash device as defined in claim 1, in which said high voltage supply circuit comprises a switch serving also to start the operation of said trigger circuit, a first capacitor, a transformer having a primary winding and a secondary winding, and a second capacitor connected in series with said secondary winding of said transformer; said switch, said first capacitor and said primary winding forming a closed circuit, and the series connection of said secondary winding of said transformer and said secondary capacitor being connection between said flash discharge tube and said main discharge capacitor.

* * * * *